US006928912B2

(12) United States Patent
Drefs et al.

(10) Patent No.: US 6,928,912 B2
(45) Date of Patent: Aug. 16, 2005

(54) METHOD AND APPARATUS FOR TRANSFERRING A WEB

(75) Inventors: Wolfgang Drefs, Hüttlingen (DE); Sylvain Demers, St. Louis de France (CA); John Eagle, Cheshire (GB)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/102,160

(22) Filed: Mar. 20, 2002

(65) Prior Publication Data

US 2002/0148874 A1 Oct. 17, 2002

(30) Foreign Application Priority Data

Mar. 26, 2001 (DE) ..... 101 15 618

(51) Int. Cl.[7] ..... B26F 3/00

(52) U.S. Cl. ..... 83/99; 83/177; 162/193; 162/286; 226/97

(58) Field of Search ..... 83/98, 99, 100, 83/53, 177; 226/7, 91, 92, 97; 162/193, 286, 194

(56) References Cited

U.S. PATENT DOCUMENTS

| | | | | | |
|---|---|---|---|---|---|
| 1,279,756 | A | * | 9/1918 | Pope | 162/193 |
| 1,595,478 | A | * | 8/1926 | Ogden | 34/452 |
| 1,688,267 | A | | 10/1928 | Cram | |
| 1,878,184 | A | * | 9/1932 | Roesen | 242/555.5 |
| 3,355,349 | A | | 11/1967 | Devlin | 162/286 |
| 3,999,696 | A | | 12/1976 | Reba et al. | 226/7 |
| 4,501,643 | A | | 2/1985 | Kiuru | 162/286 |
| 4,923,567 | A | * | 5/1990 | Liedes et al. | 162/193 |
| 5,377,930 | A | * | 1/1995 | Noyes | 242/521 |
| 5,738,760 | A | * | 4/1998 | Svanqvist et al. | 162/193 |
| 6,394,331 | B1 | * | 5/2002 | Haider | 226/91 |
| 2001/0050300 | A1 | * | 12/2001 | Hill et al. | 226/95 |

FOREIGN PATENT DOCUMENTS

| | | | | |
|---|---|---|---|---|
| DE | 199 62 731 A1 | | 6/2001 | B65G/15/58 |
| DE | 10146538 | * | 4/2003 | |
| EP | 0326535 | | 1/1988 | 21/9 |
| EP | 0359396 | * | 3/1990 | |
| WO | WO92/08005 | | 5/1992 | 21/9 |

* cited by examiner

*Primary Examiner*—Kenneth E. Peterson
(74) *Attorney, Agent, or Firm*—Taylor & Aust, P.C.

(57) ABSTRACT

An apparatus transfers a moving web of a flexible material from a web guide surface. The web guide surface outputs the moving web, and the moving web has at least one web edge. The apparatus includes at least one edge nozzle, each edge nozzle being positioned so as to be proximate one at least one web edge. Each edge nozzle is configured for separating the moving web from the web guide surface and is further configured to function as a severing device. Each edge nozzle is thereby configured for transversely severing the moving web and forming a new start portion thereof. Each edge nozzle briefly ejects therefrom a high-energy air jet, each high-energy air jet being ejected between the web guide surface and the moving web.

18 Claims, 4 Drawing Sheets

METHOD AND APPARATUS FOR TRANSFERRING A WEB

BACKGROUND OF THE INVENTION

1. Field of the Invention

The invention relates to a method and an apparatus for transferring a web made of a flexible material, especially a paper web, from a web guide surface that outputs the web to a web conveying apparatus.

2. Description of the Related Art

Normally, web transfer concerns the transfer of a threading tail, which is part (for example, an edge strip) of the aforementioned paper web. The transfer takes place, for example, from a first machine section to a following second machine section. Such machine sections can be, in particular, parts of a machine for producing or converting a paper web. For example, it concerns the transfer of the tail within or at the end of the press section of a paper making machine; within or to a winder; and/or from the end region of the drying section of the paper making machine to a following calender. This "tail transfer" is used to make threading the paper web into the machine easier.

It is the intention of the present invention to improve the methods and apparatuses which are described in U.S. Pat. Nos. 3,355,349 and 4,501,643, and also in the brochure "Double Tail Elimination" from the FIBRON Machine Corporation, New Westminster B.C., Canada. Reference is also made to German patent application DE 199 62 731.2.

U.S. Pat. No. 3,355,349 describes a vacuum belt conveyor for conveying a threading strip or tail of a paper web from the drying section of a paper making machine to the first nip of the calender thereof. The belt conveyor includes an elongated body and an air-permeable endless belt, which is mounted such that it can be moved on the body with the aid of two rollers. The endless belt has a conveying run (for example, its upper run). The conveying run travels from the region of the last drying cylinder to the region of the first nip of the calender. The belt is arranged in such a way that it picks up the threading strip from the last drying cylinder. The elongated body of the conveyor is designed as a vacuum box having a perforated upper part. The length of the vacuum box extends underneath the conveying run of the belt. Measures are provided to produce a vacuum in the box, in order to hold the threading strip on the moving belt.

At the infeed end of the known belt conveyor, a severing device or tail cutter is fixed. The severing device or tail cutter is a toothed knife which extends in the transverse direction, i.e., parallel to the roller axis. Before the belt conveyor begins to transport the tail of a web, the complete web, including the tail, runs downward from the last drying cylinder "outputting the web", past the inlet region of the belt conveyor, the web finally reaching a broke container or a broke pulper. A narrow "tail doctor" is provided on the last drying cylinder, in order to separate the tail from the outer of the drying cylinder and to transfer the tail to the belt conveyor. When the latter comes into action, the tail cutter severs the tail and, in this way, forms a new start of the tail, which is then transported to the calender. If no tail cutter were to be present, the belt conveyor would pull a piece of the tail upwards again out of the broke container and therefore transport a "double tail". Transporting a "double tail" would cause problems during the threading operation (as addressed in the abovementioned brochure "Double Tail Elimination").

The belt conveyor design which is disclosed by US '349 and by the referenced brochure has been tried and tested in operation. However, improvements are desirable with the aim that the belt conveyor be able to operate still more reliably and/or at an even higher working speed. In addition, a tail doctor should be avoided, since such an element causes impermissible wear of the outer surface of the drying cylinder.

According to US '643, an apparatus for the transverse severing and guidance of a tail is designed in such a way that it avoids moving parts and a cutting blade or knife. The tail is separated from the last drying cylinder with the aid of two edge blowing nozzles and is severed transversely with the aid of two pneumatic guide plates, which pull the tail in two different directions. The onward transport of the tail is then carried out exclusively by one of the pneumatic guide plates. It is doubtful whether this known design operates satisfactorily, at least when a paper web is to be transferred at a relatively high speed and/or when a very high operating speed is to be used.

SUMMARY OF THE INVENTION

The invention is based on further developing methods and apparatuses with the effect that as many as possible of the requirements specified below are satisfied:

1. It should be possible to carry out the transferring of the web or the threading tail more reliably than hitherto possible and to do so in the production as many different paper grades as possible, even at the extremely high operating speeds of a modem paper making or converting machine (for example, at 2000 m/min or above);

2. On the web guiding surface that outputs the web (for example, roll or cylinder outer surface), a tail doctor that has previously frequently been required should be made superfluous;

3. Likewise, a mechanical severing device (knife) for the transverse severing of the web or the tail is to be avoided;

4. During the transverse severing of the web or the tail, damage to the web or tail edges is to be avoided as much as possible in the region of the new start of the web or the tail, in order that the web or the tail does not tear in its further course, even at an extremely high running speed. For the same reason, the most stable run possible of the web or the tail from the web guide surface that outputs the web to the following web conveying apparatus, possibly to the vacuum belt conveyor, is desired to be achieved; and 5. It is to be possible to arrange the following web conveying apparatus (in particular, if present, the vacuum belt conveyor) as close as possible to the normal web running path, for example close to the web running path which runs through a scanner, as it is known.

An important finding which has led to the invention is that the edge nozzles already known previously (see, for example, U.S. Pat. No. 1,688,267, FIG. 4, numbers 80 and 82) can be used not only to separate the paper web, in particular the tail, from the web guide surface that outputs the web, but, in addition, can also be used for the transverse severing of the web or the tail. This severing succeeds under the precondition that the edge nozzles eject a high-energy air jet, whose flow velocity is as high as possible yet only briefly so (ideally, if possible, only for a fraction of a second).

According to additional concepts relating to the advantageous refinement of the apparatus according to the invention, in the inlet region, e.g., of a vacuum belt conveyor or a rope conveyor (e.g., a rope guidance system), a transfer subassembly is provided which is used specifically for the safe transfer of the web or the tail from the web guide surface that outputs the web. This subassembly includes a pneumatic guide plate with devices for producing an air flow running on the guide plate in the web running direction. In addition, the subassembly for the transverse severing of the web or the tail includes a separating and severing device, which is designed as at least one edge nozzle. The air supply to the at least one edge nozzle is designed in such a way that a high-energy air jet is ejected briefly, specifically being done so between the web guide surface that outputs the web and the web or the tail, so that the web or the tail is severed transversely immediately as it is separated from the web guide surface.

An important idea which furthers the invention is making the aforementioned transfer subassembly (i.e., including guide plate and severing device) movable (for example, relative to the vacuum belt conveyor) such that the distance between the web guide surface that outputs the web and the aforementioned subassembly can be varied. In this way, during the threading operation, the subassembly can be positioned temporarily at a very short distance from the web guide surface that outputs the web. It is therefore possible for the gap between the web guide surface that outputs the web and the web conveying apparatus to be reduced, so that the size of the web or of the tail during the threading operation is reduced to the greatest possible extent. Before the threading operation (and possibly between successive threading attempts), the aforementioned subassembly can be positioned at a certain distance from the roll or cylinder that outputs the web. As a result, the web or the tail can run downwardly without hindrance (for example, into a broke pulper), so that blockages and/or damage to the web conveying apparatus are avoided.

Because, according to the invention, both the separating of the web or the tail from the web guide surface that outputs the web and the transverse severing are carried out pneumatically with the aid of the edge nozzles, both an additional tail doctor, often required earlier, and a mechanical severing device are dispensed with.

The transfer subassembly including a guide plate and severing device can be further configured to better promote the most secure transfer possible of the new start of the web or the tail. It is possible to provide additional blower openings immediately at the infeed end of the guide plate in order to produce an air flow that supports the transport of the web or the tail. These additional blower openings should preferably briefly eject high-energy air jets or a corresponding air curtain, preferably at the same time as the edge blower nozzles. As an alternative or an addition to such blower openings, the guide plate should have at its infeed end a so-called Coanda nozzle, such a nozzle having a rounded edge which, by using the Coanda effect, deflects an air flow (of the highest possible speed) in the direction of the guide plate. By this device, a vacuum zone is produced at the rounded edge and ensures secure guidance of the tail. This produced Coanda effect avoids the situation where the edge blower nozzles, in spite of only brief effect, compress the new start of the tail laterally after the transverse severing thereof. If the guide plate has a plurality of further blowing devices arranged one after another in the manner of a cascade, at least one of these further blowing devices can also be designed as a Coanda nozzle.

According to a further, supplementary embodiment of the invention, at its end on the outlet side (i.e., close to the conveying run of the belt conveyor), the guide plate has an air guide channel, which is curved in such a way that it leads away from the running path of the web or the tail. This air guide channel has two effects. First, it ensures deflection of the air boundary layer carried along by the belt and therefore renders the latter undamaging (i.e., it is ensured that at most part of this air boundary layer passes to the point where the tail is gripped by the vacuum belt conveyor). In addition, the air flow led along on the guide plate is led on the shortest route into the suction zone of the vacuum belt conveyor, and the major part of such air flow is extracted there. As a result, the web or the tail is gripped securely by the vacuum belt conveyor and conveyed onwards as intended. The air guide channel acts in a similar way when the tail is transferred into the rope pinch of a rope guidance system.

In operation, the operations mentioned above proceed at the full operating speed of the paper making or converting machine, for example at around 2000 m/min, and occur within a fraction of a second. Therefore, the features according to the invention form the basis for improved, successful threading operations, in particular in modem high-speed paper machines.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
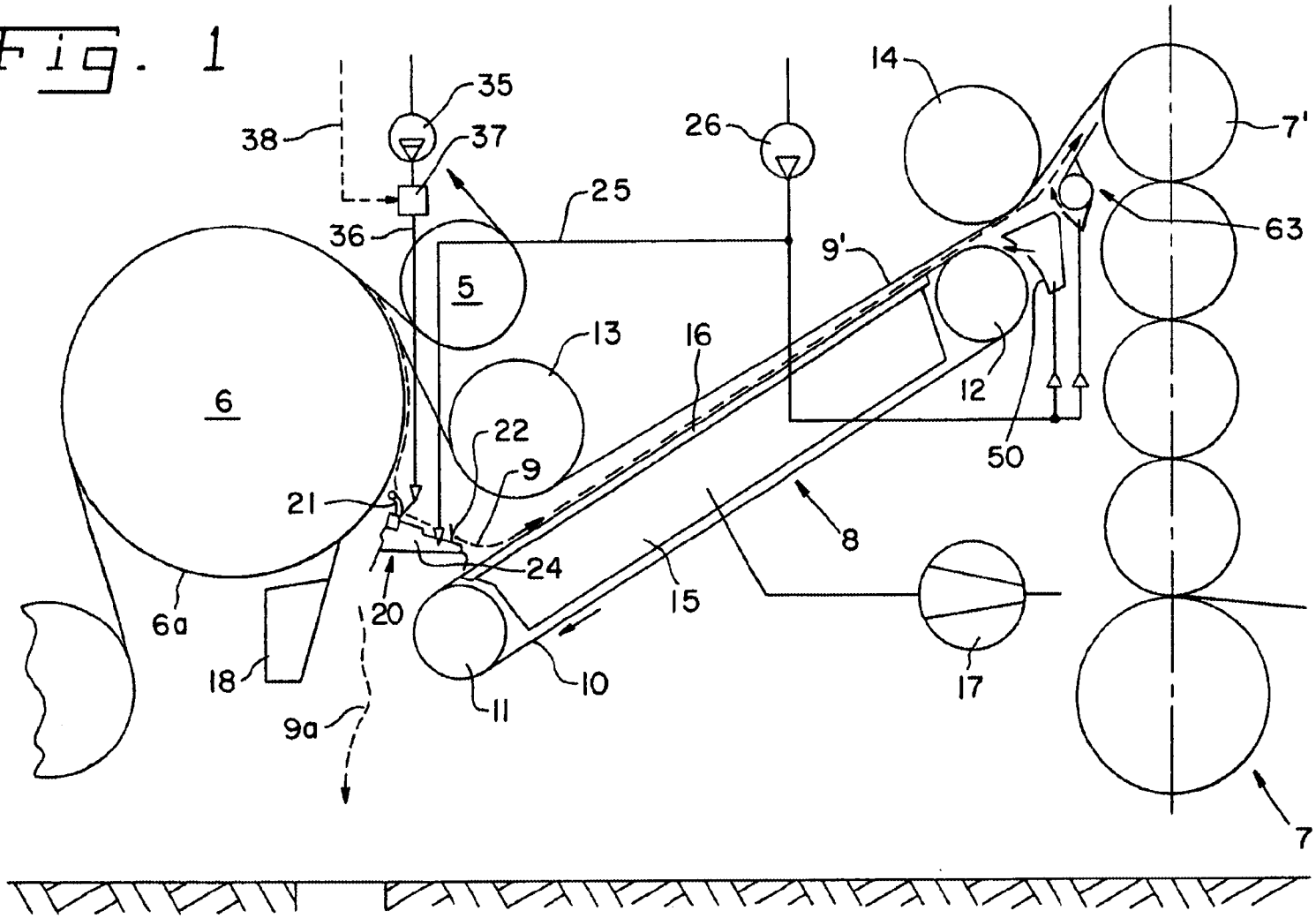
FIG. 1 is a schematic, side view of a tail transfer apparatus having a vacuum belt conveyor, arranged between a drying cylinder and a multi-roll calender of a paper machine.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

FIG. 1 reveals a vacuum belt conveyor 8 which is used to transport a moving web, preferably a threading tail 9, specifically from last drying cylinder 6 of a paper making machine, for example, to a multi-roll calender 7. As is known, threading tail 9 is part of a moving web (for example, a paper or board web). It is used to thread the web into the paper making or paper converting machine. Before the threading operation, severed web 9*a* runs downward as indicated (FIGS. 1 and 2), being guided by a machine-width doctor 18 from cylinder 6 into a broke chest (not illustrated).

Vacuum belt conveyor 8 includes an air-permeable, endless conveyor belt 10, which runs over two rollers 11, 12 and a suction box or vacuum box 15. Rollers 11, 12 are arranged such that they can rotate in holders (not illustrated) which are fixed to suction box 15. One of rollers 11, 12 is provided with a drive, not illustrated. Indicated schematically is a vacuum source 17 for producing vacuum in suction box 15.

The conveying run of conveyor belt 10, which runs in the web running direction, is the upper run in the present case; a converse arrangement is likewise possible. A suction box 15 has a top plate 16, in which slots (or similar openings) are provided. The conveying run of air-permeable conveyor belt 10 slides on plate 16. As a result, threading tail 9 is sucked onto conveyor belt 10 and transported thereby. For the further guidance of tail 9 into calender 7, a nose shoe 50, as it is known, and a pivotable guide plate 63 (which are known from EP 1 076 130) are provided at the outlet end of conveyor 8. Following a successful threading procedure, tail 9 is widened in a known manner; and the complete web, designated by 9' in FIGS. 1 and 2, then runs from cylinder 6 over paper guide rolls 13 and 14 onto uppermost roll 7' of calender 7. Suction box 15 is formed as an elongated body. Other designs which, for example, have an internal apparatus for producing a vacuum on the conveying run of belt 10, can likewise be used.

Provided in the inlet region of belt conveyor 8 is a transfer subassembly 20. Transfer subassembly 20 is a tail transfer apparatus according to the invention. Transfer subassembly 20 includes a pneumatic guide plate 22; a low-pressure chamber 24, which is connected via a line 25 to a compressed-air source 26; and a tail severing device 21 in the form of two edge nozzles. In operation, each edge nozzle 21 is arranged in one of the edge regions of tail 9 (see FIG. 2A). Each edge nozzle 21 is suitable for ejecting a high-energy air jet onto outer surface 6*a* of cylinder 6 that outputs the web. This jet achieves the situation where tail 9 running downwards is separated from cylinder outer surface 6*a* and, at the same time, tail 9 is severed transversely. From this point on, tail 9 runs with a new tail start over guide plate 22 to conveyor belt 10 and, with the latter, in the direction of calender 7.

Figure 2:
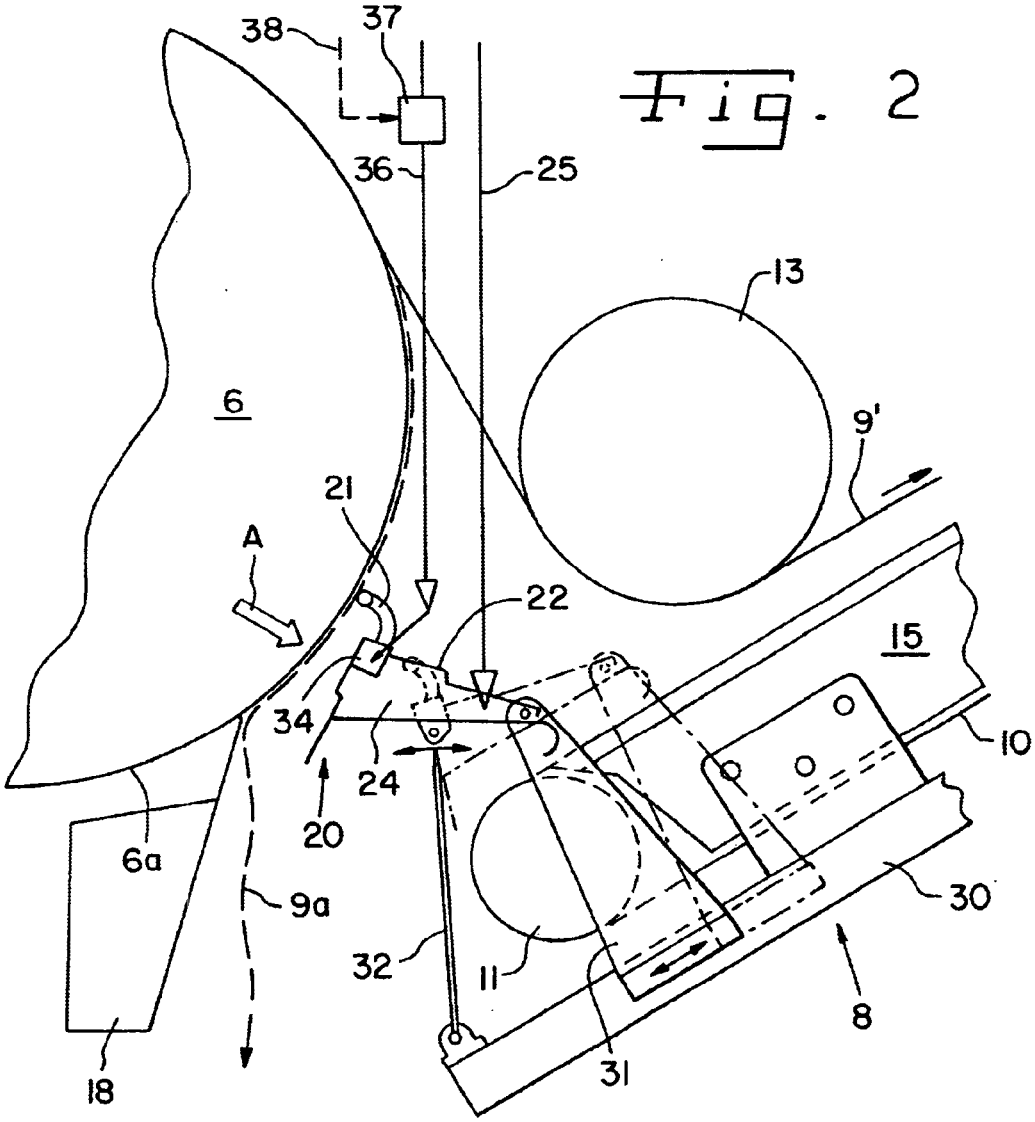
FIG. 2 is an enlarged view of the inlet region of the vacuum belt conveyor shown in FIG. 1.
Figure 2A:
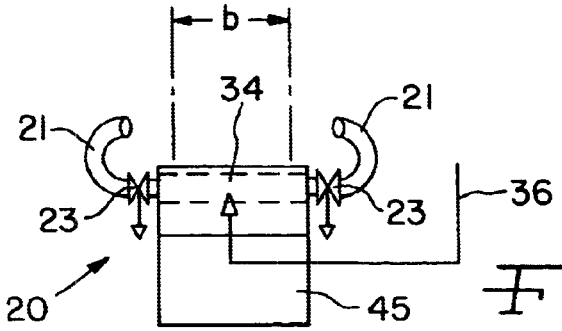
FIG. 2A is a view in the direction of the arrow A from FIG. 2.

As can be seen from FIG. 2A, width b (order of magnitude 0.2 m) of tail 9 is only a fraction of the usual width of paper web 9' produced or to be converted. It goes without saying that the working width of entire web conveying apparatus 20 is matched to tail width b. However, it is also conceivable to design transfer apparatus 20 according to the invention to be as wide as the machine in a relatively narrow paper converting machine.

FIG. 2 reveals that transfer subassembly 20 is supported on a rail 30 that is connected to suction box 15 and specifically so by a support 31 which can be displaced on rail 30 and by a pivoting lever 32. As a result, transfer subassembly 20 can optionally assume an operating position, illustrated by solid lines, or a rest position, which is illustrated by dash-dotted lines in FIG. 2. In the operating position, distance a (see FIG. 3) between edge nozzles 21 and cylinder outer surface 6*a* is only a few millimeters. In addition, guide plate 22 is inclined with respect to belt conveyor 8. By using this configuration, two outcomes are facilitated:

1. The conveying run of conveyor belt 10 runs rather close along the normal running path of paper web 9' between guide rolls 13 and 14. This running path often rises upwards, as illustrated in FIG. 1, but in other cases may be approximately horizontal; and 2. At the same time, it is advantageous for the point at which edge nozzles 21 separate tail 9 from cylinder outer surface 6*a* to be located rather far above the inlet region of belt conveyor 8 (i.e., in the region between cylinder 6 and paper guide roll 13). The tail separation position is determined, inter alia, by the desired position of dryer-fabric guide roll 5 following cylinder 6 (FIG. 1).

In the rest position of transfer subassembly 20, guide plate 22 lies approximately parallel to belt conveyor 8. Here, the distance between cylinder outer surface 6*a* and edge nozzles 21 is many times greater than in the operating position. If required, transfer subassembly 20 can also be placed temporarily in a central, intermediate position provided between the rest and operating positions. In addition, a pivoting device, not illustrated, can be provided in order to pivot the entire apparatus (belt conveyor 8 with transfer subassembly 20) out of the region of the machine.

As illustrated, edge nozzles 21 are preferably fixed immovably in transfer subassembly 20. However, it is also conceivable for edge nozzles 21 to be movable relative to guide plate 22.

Figure 3:
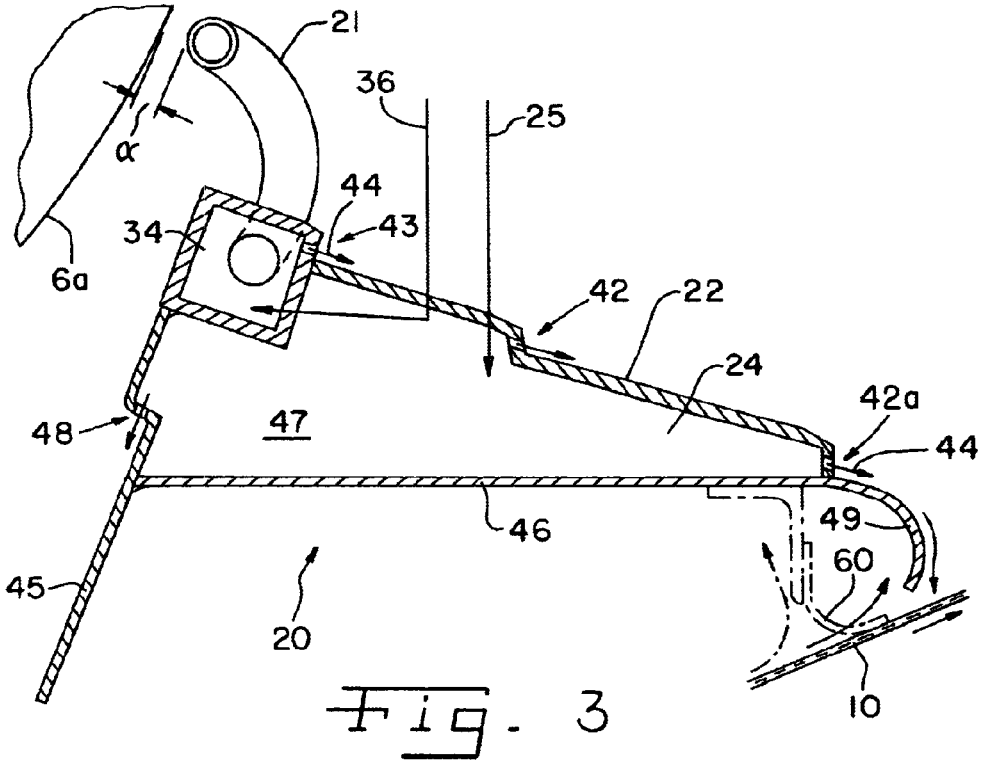
FIGS. 3–5 are schematic, side views of different embodiments of the tail transfer apparatus, located in the inlet region of the belt conveyor.
Figure 4:
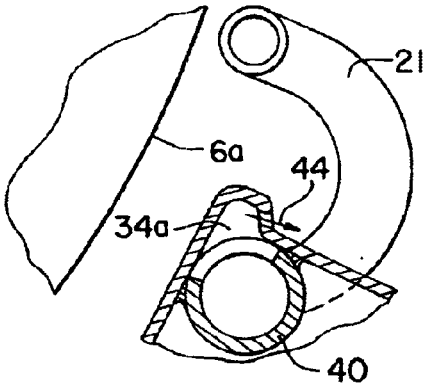
Figure 6:
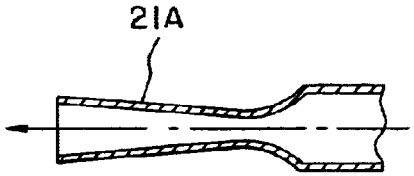
FIG. 6 is a cross-sectional view of an edge nozzle designed as a Laval nozzle.
Figure 5:
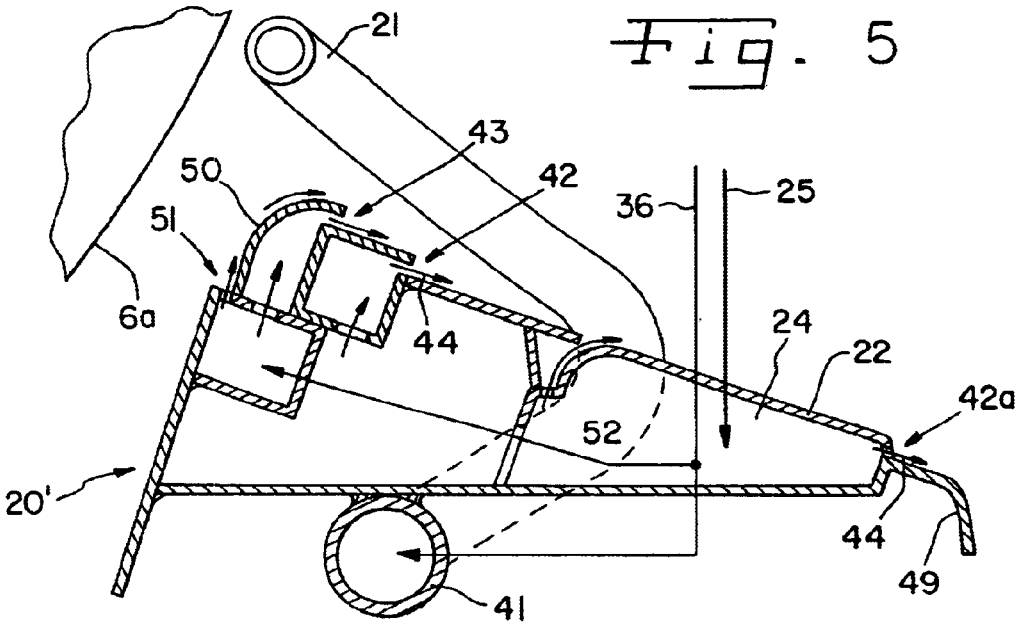

In order that edge nozzles 21 are capable of ejecting the required brief high-energy air jets, the following, by way of example, is provided: transfer subassembly 20 includes a high-pressure chamber 34, to which both edge nozzles 21 are connected (FIGS. 2 and 3). High-pressure chamber 34 can be connected via a high-pressure line 36 to a high-pressure source 35, producing compressed air having a pressure of about 5 to 15 bar (preferably about 7 to 10 bar). Provided in line 36 is a control valve 23 which, by of a timer signal carried by line 38, can be opened briefly (for example, for 0.05 to 0.5 seconds). It is important that edge nozzles 21 eject the high-energy air jet only briefly, in order that the new start of tail 9 runs onward as far as possible without damage. In order to shorten the ejection time still further, each edge nozzle 21 can be assigned its own control valve 23 (FIG. 2A). As an alternative to FIGS. 2 and 3, edge nozzles 21 can form with each other a C-shaped tubular piece 40 or 41 into which high-pressure line 36 opens, as shown in FIGS. 4, 5. If a particularly high air outlet velocity (for example, ultrasonic velocity) is needed at edge nozzles 21, it is possible to design edge nozzles 21 as Laval nozzles 21A, as shown in FIG. 6.

According to FIG. 3, transfer subassembly 20 includes high-pressure chamber 34, formed so as to have a rectangular hollow profile, and guide plate 22 which, at 42 and possibly at 42*a*, has at least one step, and which at 43 is fixed in a stepped manner to high-pressure chamber 34. Guide plate 22 and high-pressure chamber 34, together with other walls 45, 46, bound low-pressure chamber 24, already mentioned. On step 42 (and possibly on step 42*a*) there is a row of blower openings 44, which extend transversely over plate 22 and through which the air flows out of chamber 24. At step 43, additional blower openings 44 are provided on high-pressure chamber 34 and are configured to eject high-energy air jets briefly at the same time as edge nozzles 21. All blower openings 44 produce air streams which guide tail 9 along guide plates 22 in the direction of belt conveyor 8. The number of steps 42, 42*a* and 43 can be greater than or less than shown in the drawing.

Wall 45, running approximately parallel to outer surface 6*a*, can have an extension which extends downwards, in order to guide severed part 9*a* of tail 9 downwards. Here, too, if necessary, a step 48 with blower openings 44 can be provided.

A further special feature is that guide plate 22 has an air guide channel 49 at its end on the outlet side thereof, close to the conveying run of belt 10. Air guide channel 49 is curved in the direction opposite to the running direction of the conveying run. The effect of such curvature has already been described further above. In further refinement (illustrated by dash-dotted lines), a resilient seal 60 slightly touching belt 10 can be provided.

According to FIG. 4, high-pressure chamber 34*a* is configured in such a way, including C-shaped tubular piece 40 (which forms edge nozzles 21), that blower openings 44 which are active at the same time as edge nozzles 21 are positioned at a shortest possible distance a from cylinder outer surface 6*a*.

FIG. 5 shows a very advantageous further development: at the infeed end of transfer subassembly 20' there is a Coanda nozzle 50, 51 with the following features: by use of a rounded edge of nose shoe 50 and thereby using the Coanda effect, an air stream led upwards from blower openings 51 is deflected in the direction of guide plate 22. As a result, in the region of rounded edge 50, a negative pressure zone is produced, which increases the security of the start of the transfer of tail 9 still further. In addition, within guide plate 22, air can be supplied by at least one Coanda nozzle 52, in order to produce a negative pressure zone. By such at least one Coanda nozzle 52, tail 9 is supplied to belt 10 in a flat state, without any risk of fluttering.

Figure 7:
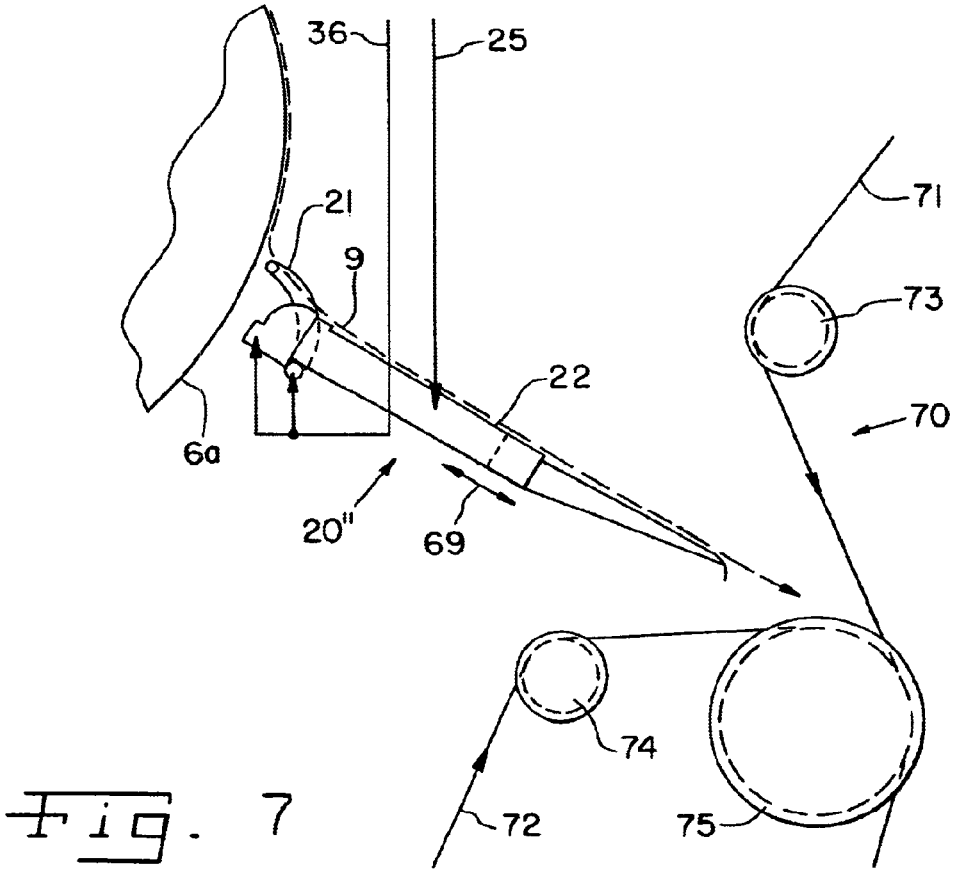
FIG. 7 is a schematic, side view of a tail transfer apparatus having a rope conveyor.

FIG. 7 shows that a tail transfer apparatus 20" according to the invention, including edge nozzles 21 and a pneumatic guide plate 22, can also be used to transfer a tail 9 separated from a cylinder outer surface 6*a* to another transport apparatus, e.g., to a rope guidance system 70, instead of to a belt conveyor 8. Illustrated schematically are two ropes 71 and 72 which run towards a roll 75 (in each case, over a rope pulley 73, 74) and there form a rope pinch, thereat gripping incoming tail 9 in order to transport tail 9 onwards together.

Here, too, provision is made for edge nozzles 21 to eject a brief high-energy air jet, in order to separate tail 9 from cylinder outer 6*a* and, at the same time, to sever tail 9 transversely, so that a new tail start is supplied to rope guidance system 70 without forming a double tail. Double arrow 69 indicates that transfer apparatus 20" can be displaced to and fro between an operating and a rest position, in a manner similar to that described above with respect to FIG. 2.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for transferring a moving web of a flexible material from a web guide surface, the web guide surface outputting the moving web, the moving web having at least one web edge, said apparatus comprising:

at least one edge nozzle, each said edge nozzle being positioned so as to be proximate one said at least one web edge, said each said edge nozzle being configured for separating the moving web from the web guide surface, said each said edge nuzzle being further configured to function as a severing device, said each said edge nozzle thereby being configured for transversely severing the moving web and forming a new start portion thereof, said each said edge nozzle briefly ejecting therefrom a high-energy air jet, each said high-energy air jet being ejected between the web guide surface and the moving web; and a transfer subassembly, said transfer subassembly including a pneumatic guide plate and said at least one edge nozzle, said transfer subassembly including at least one high-pressure chamber and at least one low-pressure chamber, said at least one high-pressure chamber connected to said at least one edge nozzle, said at least one low-pressure chamber connected to said pneumatic guide plate, said transfer subassembly having a plurality of walls defining both said at least one low-pressure chamber and said pneumatic guide plate, at least one of said plurality of walls common to both said at least one low-pressure chamber and said pneumatic guide plate, said at least one high-pressure chamber being at a higher pressure than said at least one low-pressure chamber said high pressure chamber having an opening blowing air along the pneumatic guide plate in the direction of the moving web, said low pressure chamber having plural openings blowing air along the pneumatic guide plate in the direction of the moving web.

2. The apparatus of claim 1, wherein said blower openings are configured for briefly ejecting high-energy air jets at least approximately concurrently with said at least one edge nozzle.

3. The apparatus of claim 1, further comprising a corresponding control valve operatively associated with each said edge nozzle.

4. The apparatus of claim 1, wherein said guide plate has a infeed end, said guide plate having a rounded plate edge thereat, said rounded plate edge being configured for deflecting an air stream in a direction of said guide plate, said rounded plate edge thereby being configured to employ the Coanda effect.

5. The apparatus of claim 1, wherein at least one said edge nozzle is configured as a Laval nozzle.

6. The apparatus of claim 1, further comprising a high-pressure air source configured for producing an air pressure of at least 5 bar, said high-pressure air source being fluidly coupled with each said edge nozzle.

7. The apparatus of claim 6, wherein said high-pressure air source configured for producing an air pressure in an approximate range of 7 bar to 10 bar.

8. The apparatus of claim 1, wherein the moving web is one of a paper web and a threading tail of moving paper web, the apparatus being part of a machine for at least one of producing and converting the paper web.

9. The apparatus of claim 1, wherein the web guide surface is an outer surface of one of a roll and a cylinder.

10. The apparatus of claim 1, further comprising an air flow control device configured for limiting an ejection time of the high-energy air jet from each said edge nozzle to within an approximate range of 0.05 sec to 0.5 sec.

11. The apparatus of claim 1, wherein at least one said edge nozzle is fixed to said guide plate.

12. The apparatus of claim 1, further comprising a web conveying apparatus, said web conveying apparatus including a web conveyor, said web conveyor being one of a vacuum belt conveyor and a rope conveyor, said web conveyor accepting the moving web from said guide plate and leading the moving web onward.

13. The apparatus of claim 12, wherein said web conveyor is a vacuum belt conveyor, said vacuum belt conveyor having a belt inlet region, said transfer subassembly being supported on said belt inlet region.

14. The apparatus of claim 1, wherein at least one said edge nozzle is movable relative to said guide plate.

15. The apparatus of claim 1, wherein said transfer subassembly and the web guide surface are separated by a separation distance, said transfer subassembly being movable so as to permit the separation distance to be varied.

16. The apparatus of claim 15, further comprising a web conveying apparatus, said web conveying apparatus including a vacuum belt conveyor, said vacuum belt conveyor accepting the moving web from said guide plate and leading the moving web onward, said vacuum belt conveyor including a belt, said belt having a conveying run associated therewith;

said transfer subassembly having a rest position and an operating position associated therewith, said transfer subassembly being pivotably movable between said rest position and said operating position thereof;

in said rest position, said guide plate extending approximately parallel to said conveying run;

in said operating position, said guide plate being inclined with respect to said conveying run; and said separating distance being substantially greater in the rest position than in said operating position.

17. The apparatus of claim 16, wherein said transfer subassembly can be temporarily locked in a central, intermediate position between said rest position and said operating position thereof.

18. The apparatus of claim 1, further comprising a compressed-air feed line, said moving web has a first web side and a second web side, said at least one edge nozzle including a first edge nozzle proximate said first web side and a second edge nozzle proximate said second web side, said compressed-air feed line being connected in common to said first edge nozzle and to said second edge nozzle, said first edge nozzle and said second edge nozzle thereby being connected to each other, said compressed-air feed line extending transversely with respect to said guide plate and being supported thereby.

* * * * *